United States Patent [19]

Sakai et al.

[11] Patent Number: 4,815,521

[45] Date of Patent: Mar. 28, 1989

[54] METHOD OF PRODUCING COMPOSITE STEEL BODY SHAFT

[75] Inventors: Takaaki Sakai; Mitsuru Kuragano, both of Ebina, Japan

[73] Assignee: Hitachi, Ltd., Tokyo, Japan

[21] Appl. No.: 111,628

[22] Filed: Oct. 23, 1987

[30] Foreign Application Priority Data

Oct. 24, 1986 [JP] Japan ..... 61-251780

[51] Int. Cl.[4] ..... B22D 19/06; B22D 27/02

[52] U.S. Cl. ..... 164/496; 164/497; 164/515

[58] Field of Search ..... 164/496, 497, 470, 509, 164/515

[56] References Cited

U.S. PATENT DOCUMENTS 3,972,366 8/1976 Dugan ..... 164/497

FOREIGN PATENT DOCUMENTS 2306037 10/1976 France ..... 164/497

*Primary Examiner*—Kuang Y. Lin

*Attorney, Agent, or Firm*—Antonelli, Terry & Wands

[57] ABSTRACT

A method of producing a composite steel body shaft by using at least one cooling metal mold having a cavity of a diameter and a steel body having another cavity of another diameter both of which cavities are coaxially disposed to define a through-hole in which the remelting and solidifying of electrode is effected to provide a shaft portion connected to the hollow body. At a contact position defined by both the metal mold and the hollow steel body at which contact position the diameter of the through-hole is reduced step-wise, a space is provided so that the diameter of the through hole is reduced gradually without the step-wise reduction of diameter of the through hole so as to prevent the confining of slag from occurring at the contact position.

4 Claims, 6 Drawing Sheets d ≦ D

METHOD OF PRODUCING COMPOSITE STEEL BODY SHAFT

BACKGROUND OF THE INVENTION

The present invention relates to a method of producing a composite steel body shaft used to form a shaft member such as a screw rotor having tooth portions and a shaft portion which screw rotor is used in a screw compressor, and relates more particularly to a process of producing a composite steel body shaft by electroslag remelting.

Japanese Patent Unexamined Publication No. 197232/1983 discloses an example of a method comprising the steps of providing a steel body with a cavity, inserting a consumable electrode into the cavity, melting the consumable electrode in the manner of electroslag remelting and thereafter solidifying the melt made of the consumable electrode, thereby manufacturing a composite steel body. Another example of the method, in which the consumable electrode is melted in the manner of the electroslag remelting, is disclosed in Japanese Patent Examined Publication No. 5402/1977. These methods were provided with a view to obtaining a high quality material having a fine structure. With respect to these related prior arts, no method of forming a composite steel body shaft by connecting a steel ingot 2 to the outer periphery of a central shaft member 1 made of the consumable electrode in the manner of electroslag remelting, as shown in FIG. 2, had been discussed.

Further, in the above-described prior art technique, only the connection of both a hollow steel body member and a consumable electrode material had been taken into consideration, that is, no forming of a shaft other than such connection by use of the electroslag remelting had been taken into consideration. Therefore, if a cross-sectional area of the cavity of the hollow steel body is smaller than that of the cavity of the metal mold, the upward movement of slag provided on a bath is obstructed by a steel body portion protruding radially inward from the periphery of the cavity of a larger diameter when a melting portion made of the material of the electrode reaches in the vicinity of the protruding steel body portion and when the protruding portion is to be melted, so that the slag mass cannot be smoothly raised and there is caused such a fear that a part of the slag is mixed with or confined in the remelting portion of the hollow steel body. This confined slag makes it impossible to obtain advantageous effects of the electroslag remelting technique which is used for forming a shaft portion formed in the hollow steel body so as to achieve high quality. Also, in an extreme case, there will occur a fear of serious defects in the end portion of the interface along which a shaft portion is integrated to the outer steel body, due to the confined slag.

SUMMARY OF THE INVENTION

It is an object of the present invention to provide a method of producing a composite steel body shaft of high quality by use of electroslag remelting.

The present invention provides a method of producing a composite steel body shaft, comprising the steps of:

disposing a cylindrical steel body having a cavity of a diameter (D) and two axial end surfaces so that said cylindrical steel ingot stands vertically;

disposing at least one cylindrical metal mold having a cavity of a diameter (d) so that said cylindrical metal mold stands vertically in a coaxially contacting relation to least one of said end surfaces of said steel body, thereby forming a through-hole defined by said cavities of said steel body and said mold;

forming a space of a shape having a bottom of a dimension greater than one of said diameters (D) or (d) of said cavities which one is greater than the other, said space being formed in a portion of said steel body or of said metal mold the cavity of which portion has the smaller one of said diameters, at the position of contact defined between said steel body and said metal mold at which position the diameter of said through hole is reduced from (D) to (d) or from (d) to (D) with respect to the vertically upward direction;

inserting a consumable electrode into said through hole; and effecting an electroslag remelting-and-solidifying of the electrode by supplying power to said consumable electrode so as to form a shaft portion in said through hole and so as to connect said shaft portion and said cylindrical steel body to each other.

DESCRIPTION OF THE PREFERRED EMBODIMENTS

Figure 2:
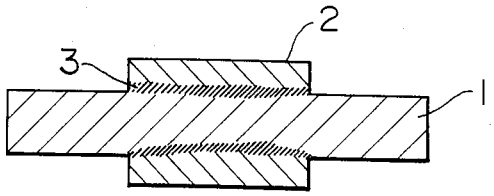
FIG. 2 is a schematic illustration of a composite steel body shaft which is produced in accordance with the present invention.
Figure 3:
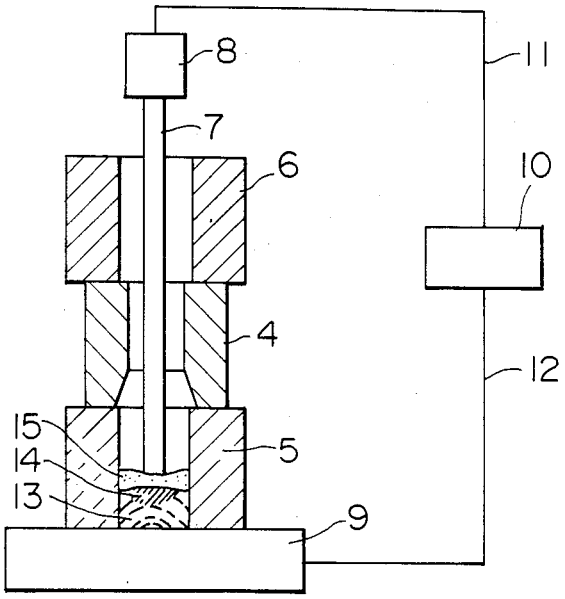
FIG. 3 is an illustration of a basic arrangement of the present invention.
Figure 4:
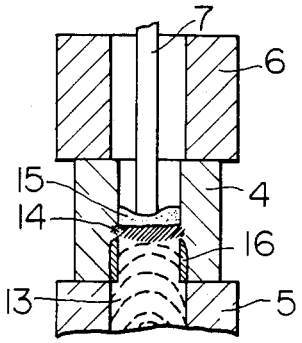
FIG. 4 is an illustration of the state of melting in a cavity of a hollow steel body.
Figure 5:
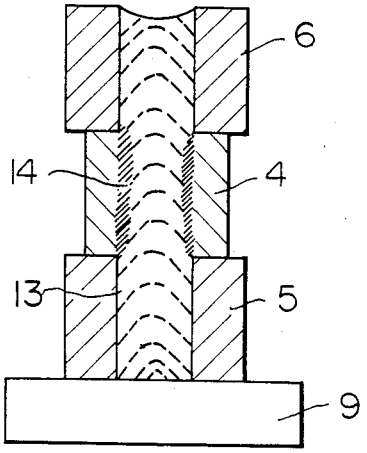
FIG. 5 is an illustration of the state of connection achieved after the completion of melting.
Figure 6A:
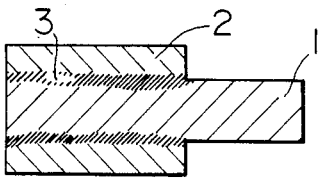
FIGS. 6 and 7 are illustrations of examples of the composite steel body.
Figure 6B:
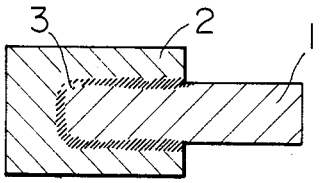
Figure 7:
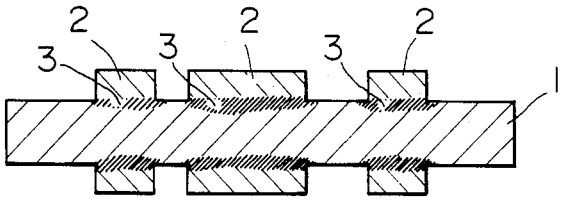
Figure 8A:
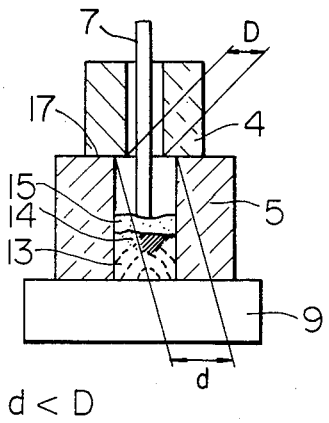
FIGS. 8A to 8E and 9A to 9E are illustrations of confining of slag during melting.
Figure 8B:
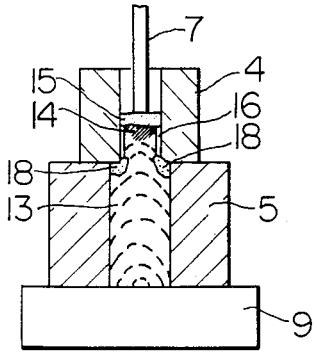
Figure 8C:
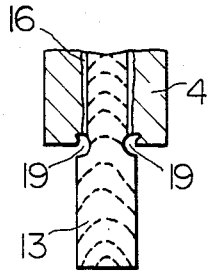
Figure 8D:
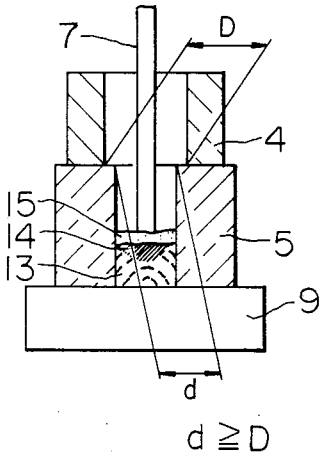
Figure 8E:
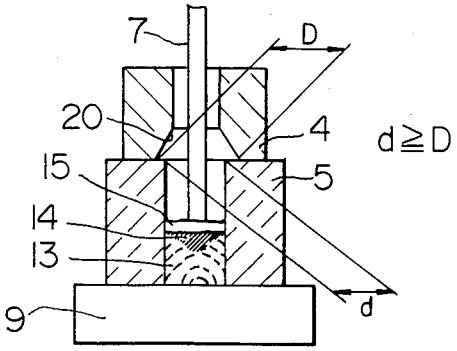
Figure 9A:
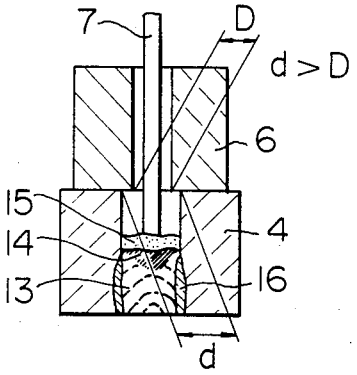
Figure 9B:
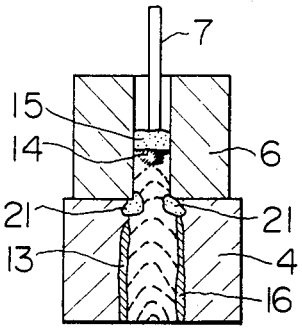
Figure 9C:
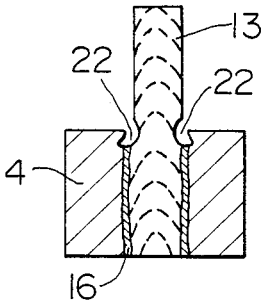
Figure 9D:
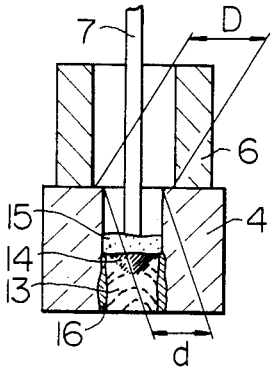
Figure 9E:
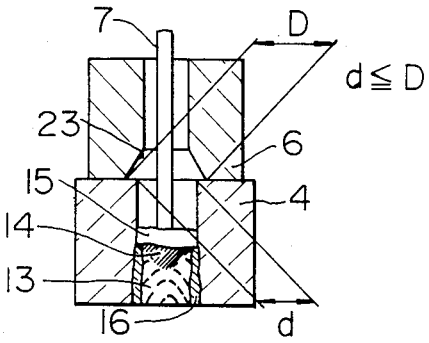
Figure 10:
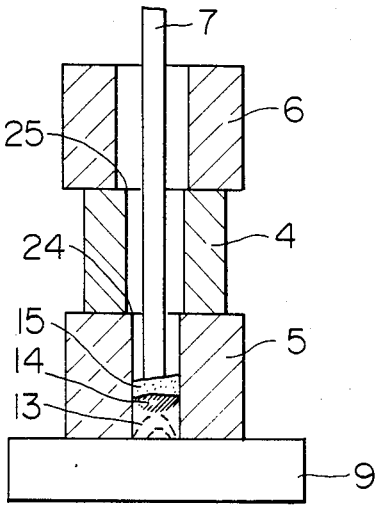
FIG. 10 is an illustration of a chamfer.

FIG. 3 is an illustration of a basic constitution of the present invention. An electroslag remelting apparatus used in the invention comprises an electrode molding base 9, power source equipment 10, current supply wirings 11 and 12, a consumable electrode 7, and an electrode-lifting device 8. In the electrode remelting apparatus, a lower cooling metal mold 5 and an upper cooling metal mold 6 are disposed to be in contact with the upper and lower ends of a hollow steel body 4, respectively. The consumable electrode 7 is inserted into a through hole defined by both the metal molds and the hollow steel body 4 all of which are disposed coaxially, and is melted under a slag 15 by current supplied from the power source equipment 10, thereby forming a melting portion 14. As the melting portion 14 moves upward, the consumable electrode 7 is raised by the electrode lifting device 8. Since the cooling metal molds 5 and 6 are cooled by means disposed outward, there is no fear of any one of the wall surfaces of the cavities of the molds being damaged by the melting portion 14, and a part of the melting portion 14 becomes a solidified portion 13 because of the removal of the heat thereof by use of the cooling mold. The consumable electrode is continuously melted under the slag 15 until the melting portion reaches the upper end of the upper cooling metal mold 6. FIG. 4 illustrates the state of melting in the cavity of the hollow steel body in which the melting portion 14 melts a wall portion of the cavity of a steel body 4 to thereby be mixed therewith and is thereafter solidified, whereby there are formed the solidified portion 13 and a connecting portion 16. The material of the consumable electrode 7 and the material of the hollow steel body 4 are thereby connected or integrated with each other completely. The state of melting in the cavity of the upper cooling metal mold 6 is the same as that of the melting in the cavity of the lower cooling metal mold 5. FIG. 5 illustrates the state of fusion connection formed after the melting has been completed. From this state, a composite steel body shaft such as that shown in FIG. 2 can be obtained by removing the upper cooling metal mold 6 and the lower cooling metal mold 5. The type of composite steel body shaft, in which a shaft portion which is formed from the material of the consumable electrode 7 protrudes beyond the opposite ends of the steel body 4, has been described above with reference to FIGS. 2 to 5. However, in a case of producing another composite steel body shaft having such a shape as in FIG. 6 in which a shaft portion protrudes only from one end of the steel body 4, either one of the upper and lower cooling mold is used. Further, in a case of connecting a plurality of hollow steel bodies 2 onto a shaft portion as shown in FIG. 7, it is necessary to coaxially dispose some of such cooling metal molds and hollow steel bodies as shown in FIG. 3. However, in this case, in order to provide means for removing the cooling metal molds, it is necessary for the cooling metal molds to be, for example, of a split type. In the method of the present invention, as described above, one or more cooling metal molds having cavities which communicate with the cavity of the hollow steel body are disposed at the upper and/or lower end of the hollow steel body, and the consumable electrode is continuously melted under the slag in a through hole defined by the cavities. Thus, it becomes possible to produce a composite steel body shaft having one or more steel body members which are disposed along and are connected to the outer periphery of the center shaft portion formed of the material of the consumable electrode, at a position or at a plurality of positions over the length of the center shaft portion.

Figure 1:
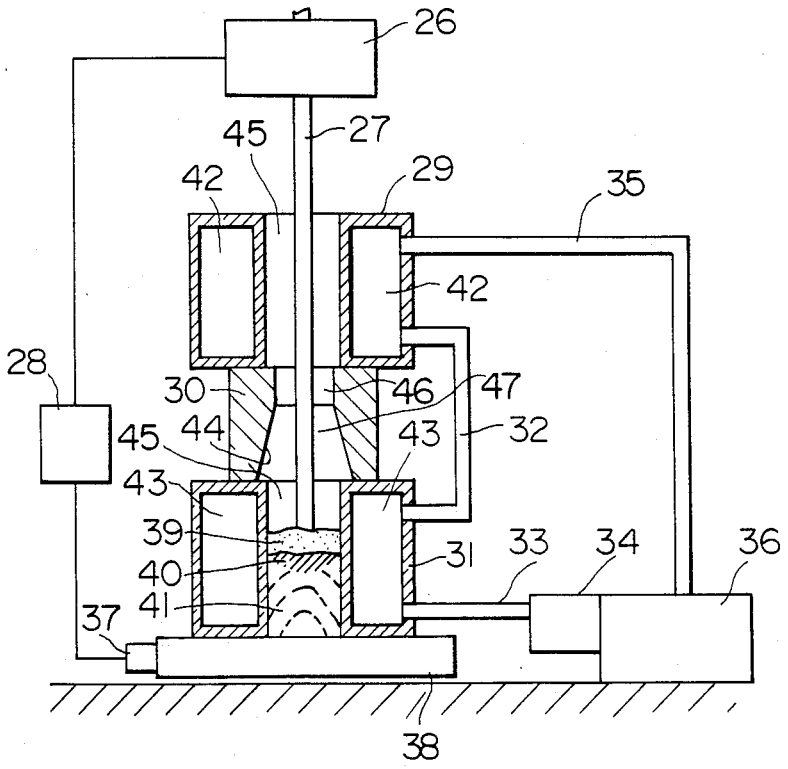
FIG. 1 is an illustration of an embodiment of the present invention.

FIGS. 8 and 9 illustrate the movement of the slag. In a case shown in FIG. 8A in which the size of the cross section of the cavity of the hollow steel body 4 is smaller than that of the cross section of the cavity of the lower cooling metal mold 5, the confining of a slag 18 occurs at a position, e.g., at the position of a contact interface 17 defined between the lower cooling metal mold 5 and the hollow steel body 4, as shown in FIG. 8B. That is, at a position of a through hole where the size of the cross section thereof is reduced step-wise with respect to a direction in which the melting portion 14 proceeds, the confining of the slag 18 occurs at this position due to a sudden reduction in the size of the cross section, with the result that the melting portion cannot melt a hollow steel body portion 4 protruding from the interface, resulting in the occurrence of a recessed or notched portion 19 in a resultant product, as shown in FIG. 8C. To prevent the formation of such notched portion, it is necessary to make the size of the cross section of the cavity of the hollow steel body portion 4 larger than the size of the cross section of the cavity of the lower cooling metal mold 5, as shown in FIG. 8D. If it is not possible to achieve this condition over the entire length of the lower cooling metal mold 5, it is necessary to provide a chamfer 20 shown in FIG. 8E, which chamber 20 defines a truncated cone shape having a lower bottom slightly larger (, for example by 1 to 3 mm) than the size (D) of the metal mold cavity, as shown in FIG. 8E, thereby preventing the confining of the slag from occurring and enabling manufacture of a composite steel body shaft having no notched portion. It is preferred that an inclination of the chamfer 20 defined with respect to the axis of the through hole is in a range of 5° to 45°. FIGS. 9A and 9B illustrate a case in which slag moves from the cavity of the hollow steel body 4 to the upper cooling metal mold 6. In this case, if, as shown in FIG. 9A, the size (D) of the cavity cross section of the upper cooling metal mold 6 is smaller than that of the cavity cross section of the hollow steel body 4, the slag-confining 21 occurs, as shown in FIG. 9B, in a manner similar to that shown in FIG. 8B, resulting in the occurrence of a notched portion 22 in the slag-confining portion solidified after melting, as shown in FIG. 9(*c*). To prevent this notched portion from occurring, it is necessary to make the size of the cross section of the cavity of the cooling metal mold 6 larger than the size of the cross section of the cavity of the hollow steel body 4, as shown in FIG. 9D. If it is impossible to make, over the entire length of the hollow steel body 4, the size of the cross section of the cavity larger than the cross section of the cavity of the hollow steel body 4, a chamfer 23, which forms a space of a truncated cone shape 23, may be formed in the lower end portion of the upper cooling metal mold 6, as shown in FIG. 9E, thereby preventing the confining of the slag from occurring and enabling manufacture of a composite steel body shaft having no notched portion. For achieving smooth upper movement of the slag and the melting portion through a through-hole having a step-wise diameter-reducing portion, it is effective to form a chamfer at a lower edge of the step-wise diameter-reducing portion of the cooling metal mold or of the hollow steel body 4, as shown in FIG. 1 or 8E, which chamfer defines a space of a truncated cone shape having a lower bottom slightly larger in size than a cavity of the metal mold (or of the hollow steel body) disposed in contact with the edge at which the truncated cone space is provided, an inclination of which chamfer is in a range of 5°–45°.

[Working Example]

Figure 11:
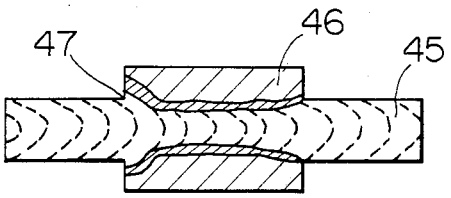
FIG. 11 is an illustration of a composite steel body shaft produced in accordance with the embodiment of the present invention.

A working example of the process embodying the present invention will now be described with reference to FIG. 1. The arrangement shown in FIG. 1 is used to produce a composite steel body shaft to be formed into a rotor for use in an oil-free screw compressor, the composite steel body shaft being in the form of a stepped round bar. A center shaft portion thereof is made of a carbon steel for machine structural use such as S45C defined in JIS G4051 which is a material of the consumable electrode 27. An outer steel body of high nickel ductile cast iron consisting of 32–46 wt. % Ni and the balance Fe and incidental impurities was connected to a part of the outer periphery of the center shaft portion. In this arrangement, a lower cooling mold 31 made of Cu which has an internal cavity 45 and which for both a columnar shape having a diameter of 39 mm and a water jacket 43 were placed on a molding board 38 made of Cu which is disposed at the lowermost position. A hollow round bar 30 made of high Ni ductile cast iron and which bar 30 has a columnar cavity 46 of 23 mm in diameter and a truncated-cone-shape space 47 was coaxially placed on the lower cooling mold 31. An upper cooling mold 29 made of Cu which has both an internal cavity 45 and a water jacket 42 was placed in an end-to-end contact coaxial relation to the hollow round bar 30. The truncated-cone-like space 47 was defined by a chamfer having an inclination of 5.2° and was provided with a lower bottom of 40 cm in diameter. The cooling metal molds were formed of copper because copper has a high thermal conductivity. Cooling water was supplied to the water jackets of the upper and lower cooling metal molds by a pump 34 which draws cooling water from a water tank 36. Cooling water was first supplied from the pump 34 to the water jacket 43 via a pipe 33, then to the water jacket 42 via a pipe 32, and was finally returned to the water tank 36 via a pipe 35. A consumable electrode 27 was inserted in the throughhole so that the lower end thereof was in the vicinity of the board 38, and electroslag remelting was started from the position immediately above the molding board 38. At this time, electric power of 500–600 ; A at 35–45V was supplied from power source equipment 28 by connecting one of the terminals thereof to the molding board 38 through a brush 37 and by connecting another terminal to the consumable electrode 27 through an electrode-lifting device 26. In this state, electroslag remelting was continuously performed successively from the lower cooling metal mold 31 to the hollow round bar 30 then to the upper cooling metal mold, thereby obtaining a composite shaft member bar for producing a composite rotor used in an oil-free screw compressor. The shaft member had a center shaft portion 45 made of the material S45C and an outer peripheral portion 46 made of the high nickel ductile cast iron connected to a part of the center shaft portion, as shown in FIG. 11. In this melting process, a chamfer 44 having an inclination of 5.2° with respect to the axis of the through-hole was provided at the lower end of the hollow round bar 30 in order to prevent the confining of slag 39 from occurring at any intermediate portion, with the result that no occurrence of a notched or recessed portion at the end portions, of the hollow round bar 30 was ensured because no confining of slag occurs during the upper movement of the slag and remelting metal.

As described above, the present invention ensures that the slag can be smoothly moved upward, thereby enabling the production of a composite steel body shaft of high quality.

What is claimed is:

1. A method of producing a composite steel body shaft, comprising the steps of:

providing a cylindrical steel body having a cavity of a diameter (D) and two axial end surfaces, and at least one cylindrical metal mold having a cavity of a diameter (d), such that said cylindrical steel body and said at least one metal mold are arranged so that said cylindrical metal mold and said cylindrical steel body both stand vertically in a coaxially contacting relation with said steel body being located above said at least one metal mold end surface, thereby forming a through-hole defined by said cavities of said steel body and said mold, the cavity diameter (D) of said cylindrical steel body being smaller than the cavity diameter of the cylindrical metal mold and wherein a space of a truncated cone shape is formed in said steel body, said truncated cone shape having a bottom of a dimension greater than said diameter (d) of said mold cavity in said metal mold and said truncated cone shape having a tilted curved surface which is inclined in a range of 5° to 45° with respect to the axis of the through-hole, said space being formed in a portion of said steel body at the position of contact defined between said steel body and said metal mold at which the diameter of said through-hole is reduced from (d) to (D) with respect to the vertically upward direction;

inserting a consumable electrode into said through-hole; and effecting an electroslag remelting-and-solidifying of the electrode by supplying power to said consumable electrode so as to form a shaft portion in said through-hole and so as to connect said shaft portion and said cylindrical steel body to each other.

2. A method of producing a composite steel body shaft according to claim 1, wherein the cross sectional area of said space is reduced linearly with respect to a direction advancing upward from said position of contact at which said steel body contacts said mold.

3. A method of producing a composite steel body shaft according to claim 1, wherein the shaft portion is made of a carbon steel for machine structural use, the steel body integrally connected onto the shaft portion being made of a high nickel ductile cast iron.

4. A method of producing a composite steel body shaft according to claim 3 wherein the high nickel ductile cast iron consists essentially, by weight, of 32 to 46% nickel and the balance iron.

* * * * *